US008216085B2

(12) United States Patent
Fujimoto

(10) Patent No.: US 8,216,085 B2
(45) Date of Patent: Jul. 10, 2012

(54) GOLF CLUB

(75) Inventor: Hiroaki Fujimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 166 days.

(21) Appl. No.: 12/393,764

(22) Filed: Feb. 26, 2009

(65) Prior Publication Data

US 2009/0318242 A1 Dec. 24, 2009

(30) Foreign Application Priority Data

Jun. 19, 2008 (JP) ..... 2008-159825

(51) Int. Cl.
*A63B 53/00* (2006.01)

(52) U.S. Cl. ..... 473/292; 473/297

(58) Field of Classification Search ..... 473/282, 473/292, 297, 305, 300
See application file for complete search history.

(56) References Cited

U.S. PATENT DOCUMENTS

| | | | | |
|---|---|---|---|---|
| 5,145,171 | A * | 9/1992 | Head et al. | 473/300 |
| 5,467,984 | A * | 11/1995 | Veux et al. | 473/291 |
| 5,716,289 | A * | 2/1998 | Okoneski | 473/297 |
| 5,910,056 | A * | 6/1999 | Nagamoto et al. | 473/305 |
| 6,656,057 | B2 * | 12/2003 | Manual et al. | 473/300 |
| 7,338,386 | B2 * | 3/2008 | Nakajima | 473/319 |
| 7,399,235 | B2 * | 7/2008 | Gill et al. | 473/297 |
| 7,530,903 | B2 * | 5/2009 | Imamoto et al. | 473/335 |
| 7,559,851 | B2 * | 7/2009 | Cackett et al. | 473/300 |
| 7,909,705 | B2 * | 3/2011 | Gill et al. | 473/297 |
| 2003/0207241 | A1 * | 11/2003 | Manual et al. | 434/252 |
| 2006/0142093 | A1 * | 6/2006 | Moriyama | 473/292 |
| 2007/0105642 | A1 * | 5/2007 | Ban | 473/297 |
| 2007/0105643 | A1 * | 5/2007 | Sugimae et al. | 473/305 |
| 2010/0081515 | A1 * | 4/2010 | White et al. | 473/296 |

FOREIGN PATENT DOCUMENTS

| | | | |
|---|---|---|---|
| JP | 2005-245947 | A | 9/2005 |
| JP | 2007-136067 | A | 6/2007 |

* cited by examiner

*Primary Examiner* — Stephen L. Blau
(74) *Attorney, Agent, or Firm* — Birch, Stewart, Kolasch & Birch, LLP

(57) ABSTRACT

A golf club 2 includes a shaft 6, a tip member provided at a tip part of the shaft 6, and a rear end member attached to a rear end part of the shaft 6. The tip member includes a head 4. The rear end member includes a grip 8 and a weight member 20. The golf club has a club length of 1143 mm or more. A value of [W2/W1] is no less than 0.23 and no more than 0.32 when a weight of the tip member is W1 (g) and a weight of the rear end member is W2 (g). The weight member 20 is provided on a rear side relative to a tip position of the grip. The weight member 20 has a specific gravity larger than that of the shaft 6. The golf club 2 is a wood type golf club. Examples of materials for the weight member 20 include brass, a tungsten nickel alloy, an aluminum alloy, a tungsten alloy, a stainless alloy, stainless steel, and the like.

3 Claims, 6 Drawing Sheets

GOLF CLUB

The present application claims priority to Japan Patent Application No. 2008-159825, filed Jun. 19, 2008, incorporated herein by reference in its entirety.

BACKGROUND OF THE INVENTION

1. Field of the Invention

The present invention relates to a golf club.

2. Description of the Related Art

Examples of means for being capable of enhancing the performance of a golf club include the enhancement of a coefficient of restitution. However, the regulation on the coefficient of restitution has been introduced in accordance with golf rule in recent years. The enhancement of the performance caused by a means other than the coefficient of restitution is particularly required after the introduction of the regulation.

The increase in the length of the golf club (lengthening) can contribute to the increase in a head speed. The reduction of the weight of the golf club (weight saving) can contribute to the increase in the head speed. However, the lengthening may reduce easiness to swing to reduce the stability of swing and a hit ball directivity. The weight saving of a head reduces the coefficient of restitution. The weight saving of the head may also reduce the moment of inertia of the head, and thus reduce the hit ball directivity.

Japanese Patent Application Laid-Open Publication No. 2005-245947 discloses a golf club obtained by combining a short club length, a heavy head and a light shaft in order to attain both a flying distance and hit ball directivity. Japanese Patent Application Laid-Open Publication No. 2005-245947 describes that a balance weight is attached to a grip end in order to easily swing a club having a heavy head.

SUMMARY OF THE INVENTION

In the invention of the above prior literature, the golf club is shortened from the viewpoint of the easiness to swing, and the weight of the head is increased from the viewpoint of the flying distance. The present invention attains both the flying distance and the hit ball directivity based on a technical thought different from that of the above prior literature.

It is an object of the present invention to provide a golf club capable of simultaneously achieving the flying distance and the hit ball directivity.

The golf club head according to the present invention is provided with a shaft; a tip member provided at a tip part of the shaft; and a rear end member attached to a rear end part of the shaft. The tip member includes a golf club head. The rear end member includes a grip. The golf club has a club length of 1143 mm or more. A value of [W2/W1] is no less than 0.23 and no more than 0.32 when a weight of the tip member is W1 (g) and a weight of the rear end member is W2 (g).

Preferably, the rear end member includes a weight member. The weight member is provided on the rear side (rear end side) relative to a tip position of the grip. The weight member has a specific gravity larger than that of the grip.

The flying distance and the hit ball directivity can be simultaneously achieved by the long golf club which is easy to swing.

DESCRIPTION OF THE PREFERRED EMBODIMENTS

Hereinafter, the present invention will be described in detail based on preferred embodiments with reference to the drawings appropriately.

Figure 1:
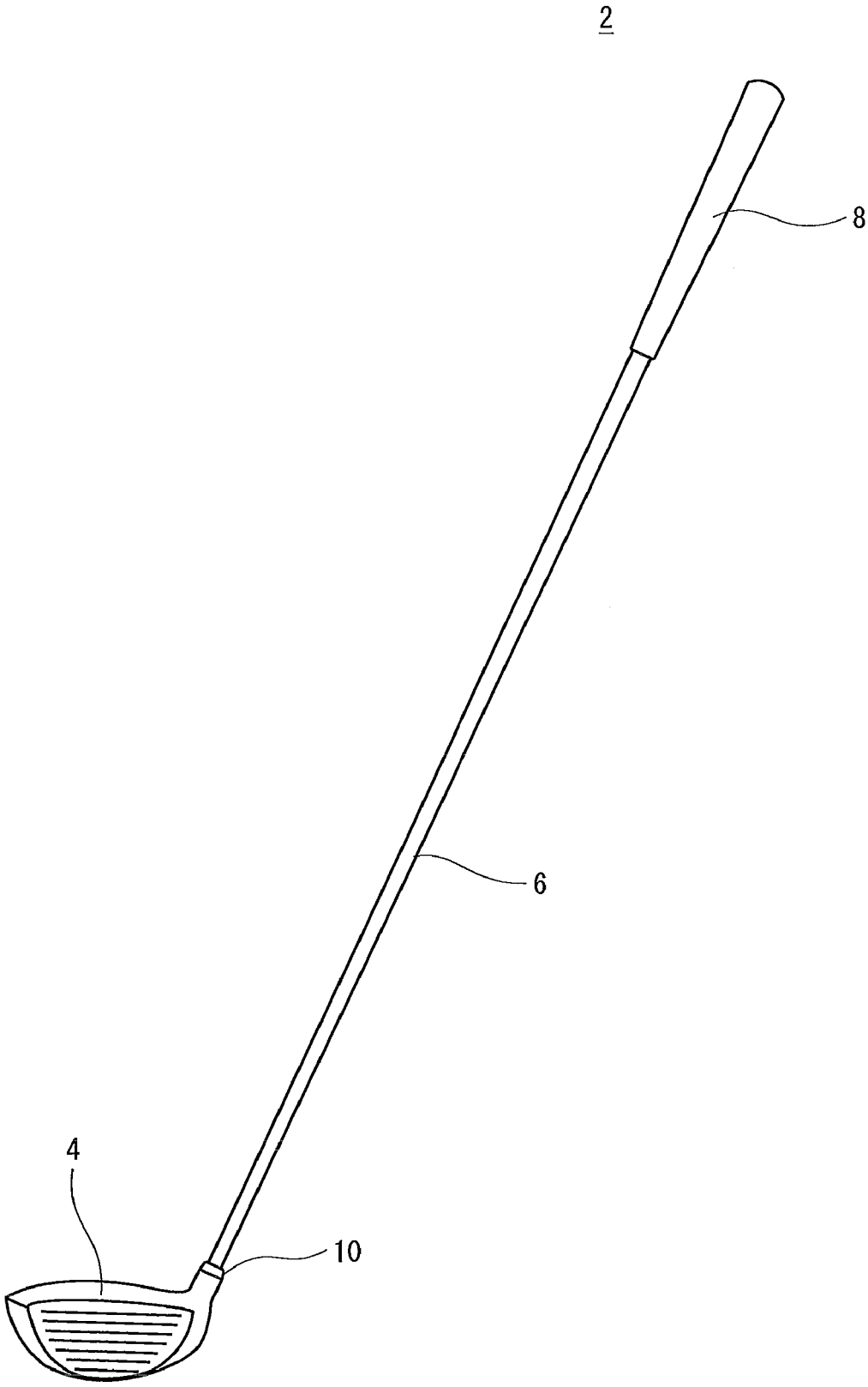
FIG. 1 is an overall view of a golf club according to one embodiment of the present invention.

As shown in FIG. 1, a golf club 2 has a head 4, a shaft 6, a grip 8 and a ferrule 10. The head 4 is provided at a first end part of the shaft 6. The head 4 is provided at a tip part of the shaft 6. The grip 8 is provided at a second end part of the shaft 6. The grip 8 is provided at a rear end part of the shaft 6. The ferrule 10 is provided in contact with a hosel end surface of the head 4.

The head 4 is a wood type golf club head. The head 4 has a hollow structure (not shown). The face surface of the head 4 is a curved surface (not shown). The face surface has a face bulge and a face roll.

Figure 2:
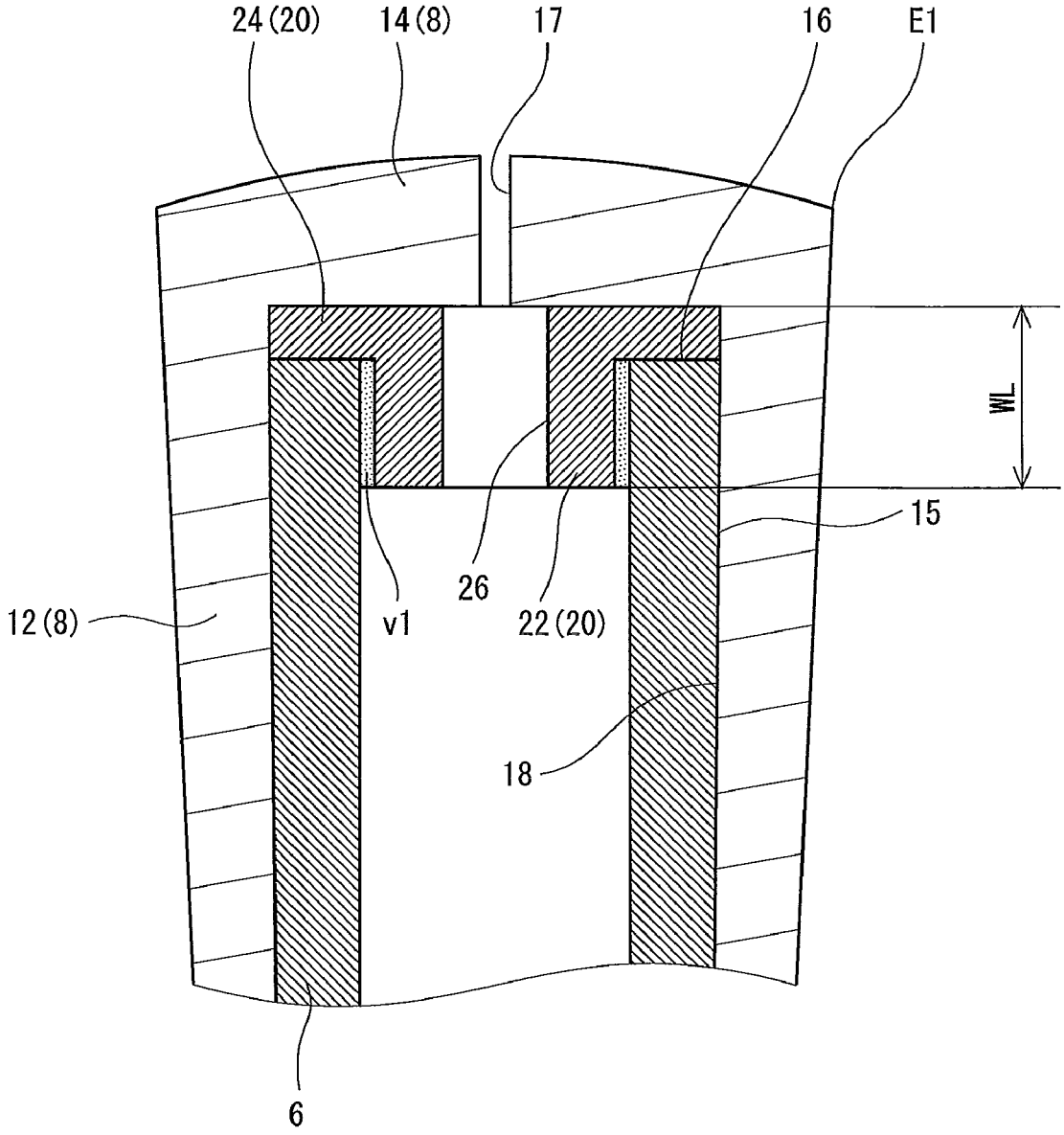
FIG. 2 is a sectional view in the vicinity of a grip end of the golf club of FIG. 1.

FIG. 2 is a sectional view in the vicinity of the grip end of the golf club 2. FIG. 2 is a sectional view along a shaft axial line.

As shown in FIG. 2, the shaft 6 has a tubular shape. The inside of the shaft 6 is hollow. The shaft 6 has a taper part having an outer diameter gradually decreasing in response to getting near to a tip (a head side). The shaft 6 has a tip part inserted into a hosel hole of the head 4. The shaft 6 and the head 4 are bonded by an adhesive.

The grip 8 is made of an elastic body. The grip 8 covers the external surface of the shaft 6. As shown in FIG. 2, the grip 8 has a tubular part 12 and an end part 14. The tubular part 12 covers the outer peripheral surface 15 of the shaft 6. The end part 14 covers a rear end surface 16 of the shaft 6. Furthermore, the end part 14 closes an opening formed in the rear end of the shaft 6. A through-hole 17 is formed in the central position of the end part 14. This through-hole 17 may function as a passage through which air passes.

The grip 8 and the shaft 6 are bonded by a double-faced tape (not shown). The double-faced tape exists between the inner circumference surface 18 of the grip 8 and the outer circumference surface 15 of the shaft 6 (not shown).

As shown in FIG. 2, the golf club 2 has a weight member 20. The weight member 20 is provided in the grip 8. In the golf club 2, the weight member 20 is not visually recognized from the outside. The weight member 20 is bonded on the shaft 6. An adhesive v1 exists between the weight member 20 and the shaft 6. In FIG. 2, the section of the adhesive v1 is shown by a dotted pattern (dot).

Figure 3:
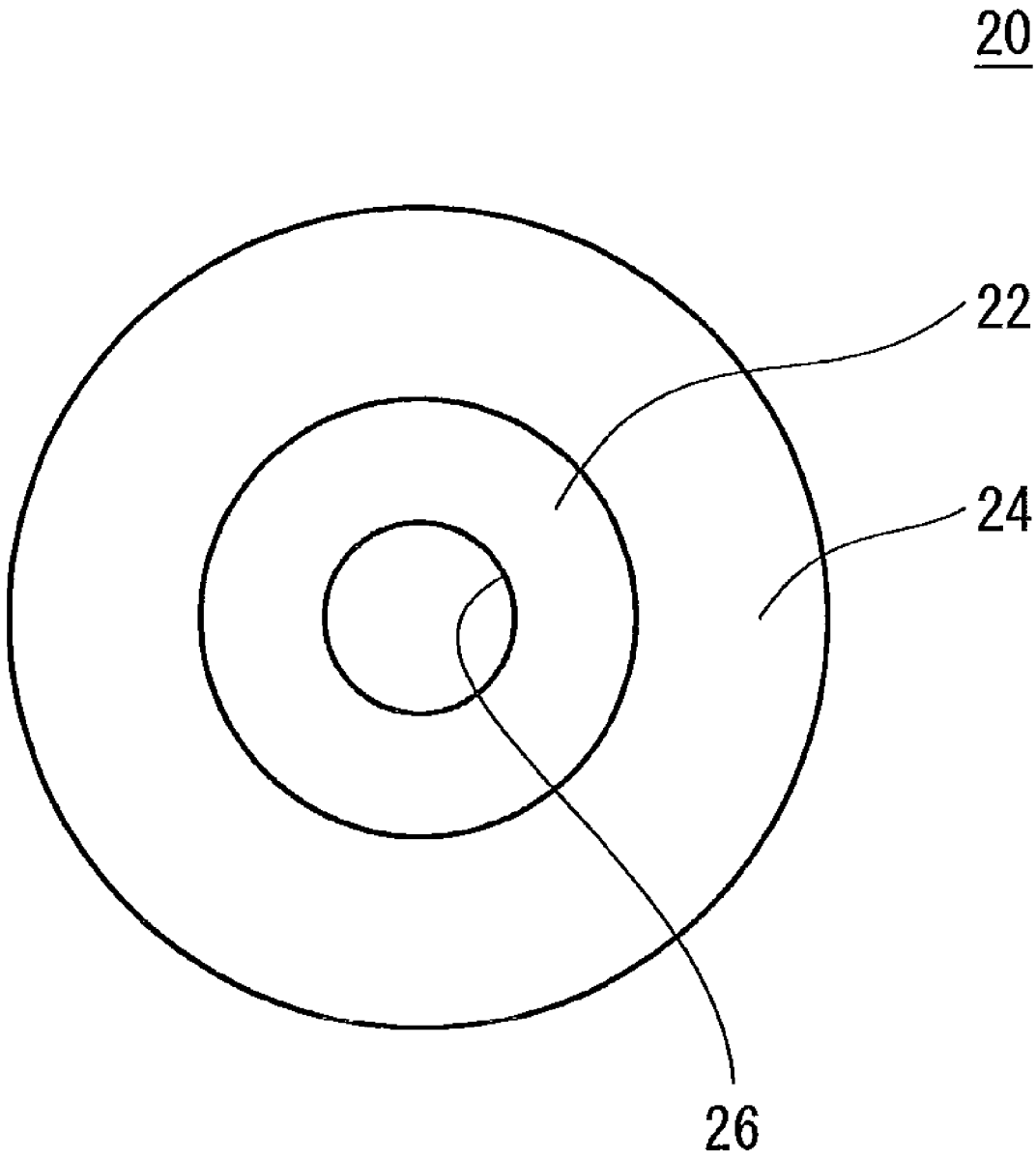
FIG. 3 is a plan view of a weight member.
Figure 4:
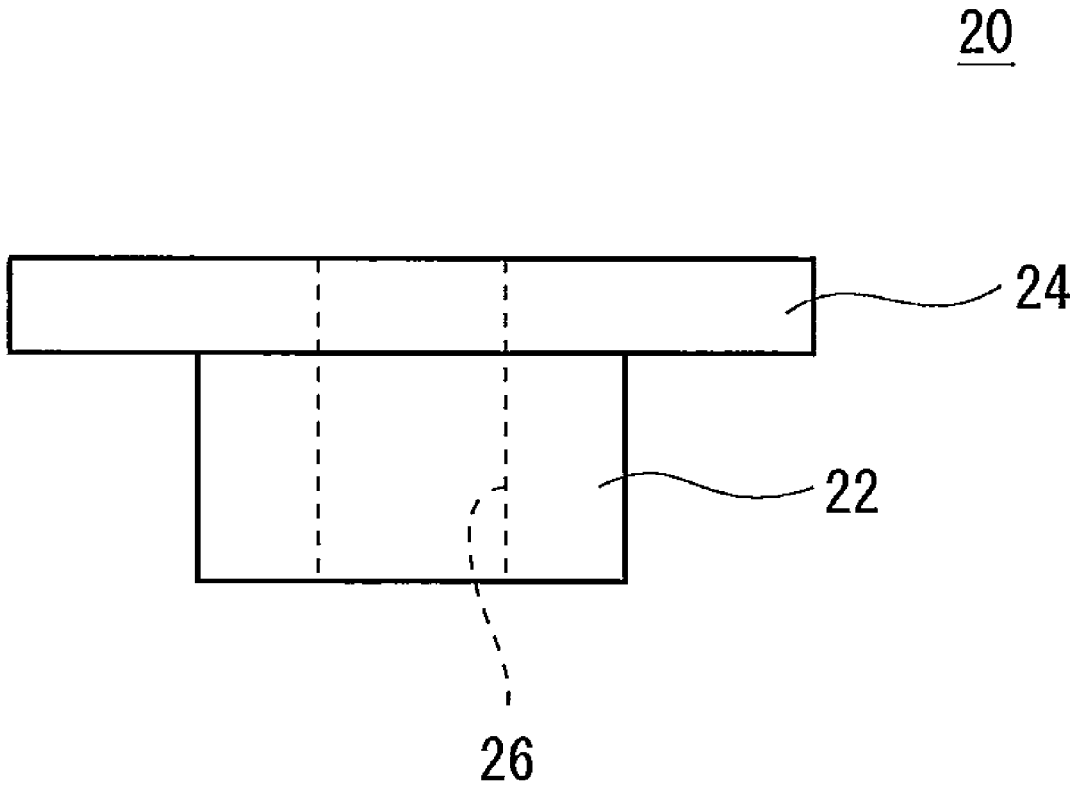
FIG. 4 is a side view of a weight member.

FIG. 3 is a plan view of the weight member 20, and FIG. 4 is a side view of the weight member 20. The weight member 20 has a small-diameter part 22 and a large-diameter part 24. The small-diameter part 22 and the large-diameter part 24 are coaxially provided. In the golf club 2, the weight member 20 and the shaft 6 are substantially coaxially provided. The weight member 20 has a through-hole 26 formed along the center axial line of the weight member 20. The small-diameter part 22 may be inserted into the hollow part of the shaft 6. The outer diameter of the large-diameter part 24 is larger than the inner diameter of the shaft in the rear end surface 16 of the shaft 6. The outer diameter of the large-diameter part 24 is the same as that of the shaft in the rear end surface 16 of the shaft 6, or smaller than that of the shaft in the rear end surface 16 of the shaft 6. The large-diameter part 24 is in contact with the rear end surface 16 of the shaft 6. The small-diameter part 22 is inserted into the hollow part of the shaft 6 with the large-diameter part 24 being in contact with the rear end surface 16. The outer circumference surface of the small-diameter part 22 and the inner circumference surface of the shaft 6 are bonded.

The weight member 20 is provided in the rear end part of the shaft 6. The weight member 20 exists at a same position in the axial direction as that of the rear end surface 16 of the shaft 6. In the present application, the axial direction means the direction of the shaft axial line.

Figure 5:
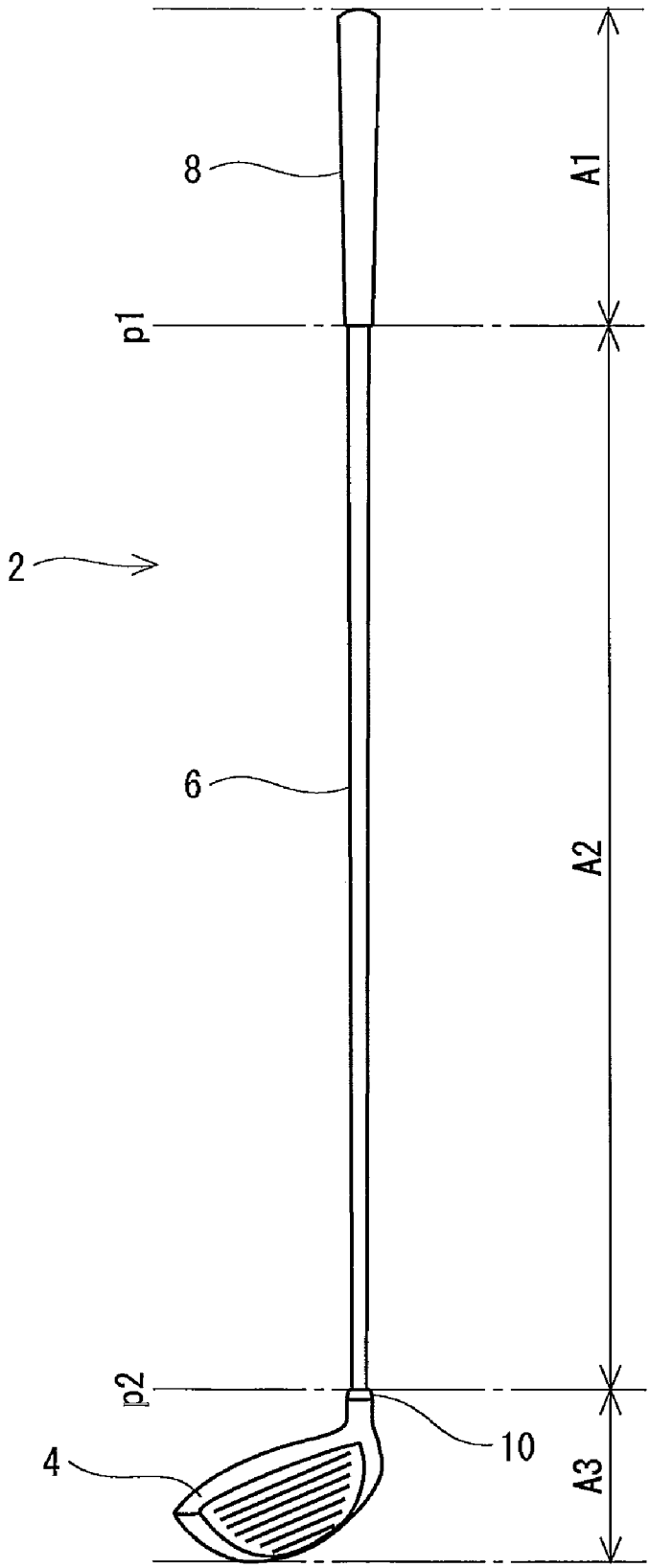
FIG. 5 is an illustration for explaining three areas in the golf club.

In the present invention, a first area, a second area and a third area are defined as the area of the golf club. FIG. 5 is an illustration for showing the first area A1, the second area A2 and the third area A3.

As shown in FIG. 5, the first area A1 is an area further on the rear end side than a grip tip position p1. The grip tip position p1 is a position of the end of the grip 8 on the head 4 side. The grip tip position p1 is a position in the axial direction.

As shown in FIG. 5, the third area A3 is an area further on the top side than a head rear end position p2. The head rear end position p2 is a position of the end of the head 4 on the grip 8 side. However, when an abut member which is a member other than the shaft 6 and is a member which is in contact with the head 4 exists, the position of the end of the abut member on the grip 8 side is defined as the head rear end position p2. As shown in FIG. 5, in this embodiment, the rear end position of the ferrule 10 is the head rear end position p2. The head rear end position p2 is a position in the axial direction. In the case of the golf club having no ferrule, the head rear end position p2 is usually the position of the axial direction of the hosel end surface.

As shown in FIG. 5, the second area A2 is an area from the grip tip position p1 to the head rear end position p2. The second area A2 is an area including the grip tip position p1 and the head rear end position p2.

In the present invention, a club length L1 (mm) is set to 1143 mm or more. In the present invention, the club length L1 is set to 1143 mm or more to enhance the head speed. This club length L1 is usually applied to the wood type golf club. From this viewpoint, the golf club of the present invention is preferably the wood type golf club.

From the viewpoint of enhancing the head speed, the club length L1 is preferably 1149 mm or more, and more preferably 1155 mm or more. From the viewpoints of easiness to swing and the hit ball directivity, the club length L1 is preferably 1219 mm or less, and more preferably 1213 mm or less.

Figure 6:
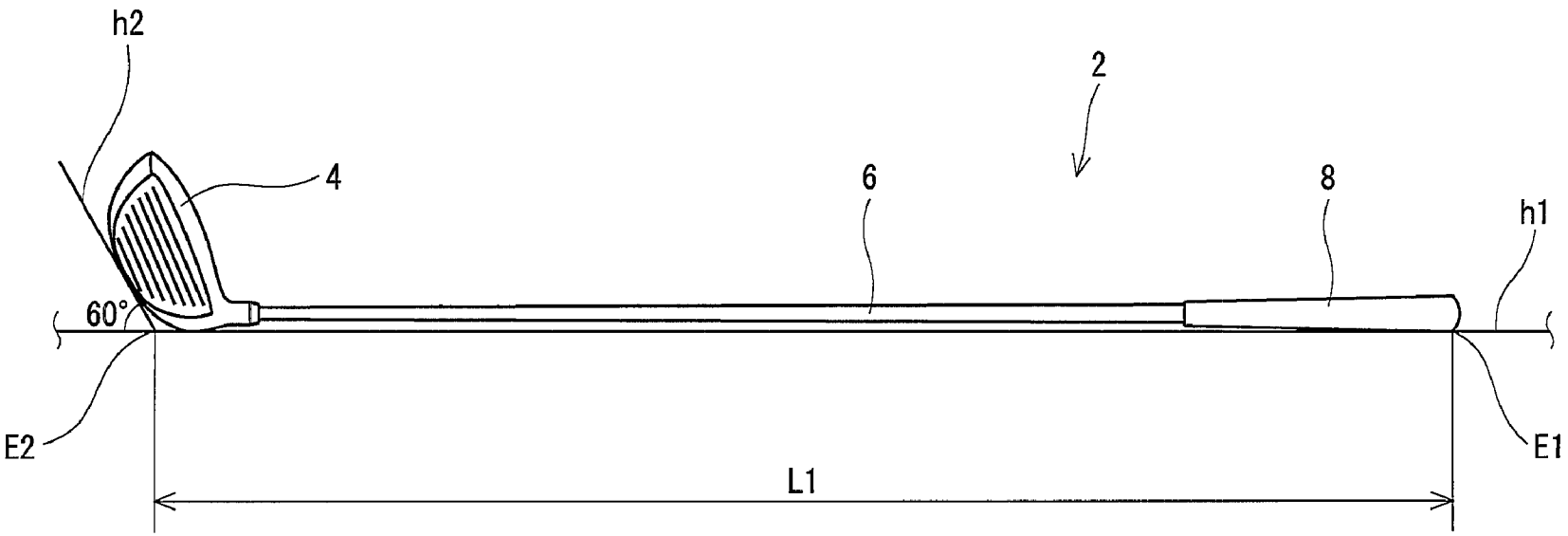
FIG. 6 is an illustration for explaining a method for measuring a club length.

FIG. 6 is an illustration for explaining a method for measuring the club length L1. The club length L1 is measured on the basis of "c. Length" in an item of an auxiliary rule II, "1. Club" in JGA (Japan Golf Association) golf rule. Specifically, the club length L1 is measured by placing the golf club 2 on a horizontal plane h1 as shown in FIG. 6, and applying a sole surface of the head 4 to an inclined plane h2 which is inclined at 60 degrees with respect to the horizontal plane h1. The inclined plane h2 is a plane (flat surface). The head 4 is applied to the inclined plane h2 in a stable state as much as possible. The club length L1 is measured as a distance (shortest distance) from an intersection E2 between the horizontal plane h1 and the inclined plane h2 to a grip rear end E1. As shown in FIG. 2, when a convex bulge rearward is provided in the grip rear end, the edge on the grip rear end side is the grip rear end E1. Usually, in the grip rear end E1, the outer diameter of the grip is the maximum.

When the club length L1 is set to 1143 mm or more, it becomes difficult to swing the club, and thus the hit ball directivity is apt to reduce. The present inventor found that a golf club could be attained, which is easy to swing even if the club length L1 is large, by setting [W2/W1] within the non-conventional range described above when the club length L1 is 1143 mm or more. The reduction of the durability of the club and the reduction of a hitting force to a ball can be suppressed, and the hit ball directivity and a flying distance can be effectively improved by setting [W2/W1] to 0.23 or more. From this viewpoint, [W2/W1] is more preferably 0.26 or more. Since a head weight Wh is apt to decrease when [W2/W1] is excessively large, the restitution performance is apt to decrease and thus the flight distance is apt to decrease. Since the moment of inertia of the head is apt to decrease when the head weight Wh is excessively small, the hit ball directivity is apt to degrade. From these viewpoints, [W2/W1] is preferably 0.32 or less, and more preferably 0.29 or less.

In the present application, the following weight is defined. Unless otherwise described, the unit of the weight described in the present application is gram (g).

(1) Club Weight Wt

The club weight Wt is the weight of the golf club 2. The unit of the club weight Wt is gram (g).

(2) Shaft Weight Ws

The shaft weight Ws is the weight of the shaft 6. That is, the shaft weight Ws is the weight of only the shaft 6. The unit of the shaft weight Ws is gram (g).

(3) Head Weight Wh

The head weight Wh is the weight of the head 4. That is, the head weight Wh is the weight of only the head 4. The unit of the head weight Wh is gram (g). When a weight adjusting material is provided in the head or on the external surface of the head, the weight of this weight adjusting material is also contained in the head weight Wh. As this weight adjusting material, an adhesive resin for weight adjustment provided in the head is exemplified. As another weight adjusting material, a plate-like metal member (lead plate or the like) attached on the external surface of the head is exemplified.

(4) Weight W1 of Tip Member

The weight W1 of the tip member is the total weight existing in the third area A3. However, the weight of the shaft 6 is not contained in the weight W1 of the tip member. Typically, the weight W1 of the tip member is the total of the head weight Wh, the weight of the ferrule 10 and the weight of an adhesive. This adhesive bonds the head and the shaft. When the golf club 2 includes a bush for balance adjustment, the weight of this bush may be also contained in the weight W1 of the tip member.

(5) Grip Weight Wg

The grip weight Wg is the weight of the grip. That is, the grip weight Wg is the weight of only the grip. The unit of the grip weight Wg is gram (g).

(6) Weight Ww of Weight Member

The weight Ww of the weight member is the weight of the weight member. That is, the weight Ww of the weight member is the weight of only the weight member. The unit of the weight Ww of the weight member is gram (g). The weight member exists in the first area A1.

(7) Weight W2 of Rear End Member

The weight W2 of the rear end member is the total weight existing in the first area A1. However, the weight of the shaft 6 is not contained in the weight W2 of the rear end member. In the embodiment of FIG. 2, the weight W2 of the rear end member is the total of the grip weight Wg, the weight of the double-faced tape and the weight Ww of the weight member 20. This double-faced tape bonds the shaft 6 and the grip 8 as described above.

From the viewpoint of increase in the hitting force to the ball, the weight W1 of the tip member is preferably 160 (g) or more, more preferably 180 (g) or more, and still more preferably 185 (g) or more. When the weight W1 of the tip member is excessively large, the swing speed is apt to decrease and the flying distance is apt to be reduced. When the weight W1 of the tip member is excessively large, it becomes difficult to swing the club and the hit ball directivity is apt to be reduced. From these viewpoints, the weight W1of the tip member is preferably 220 (g) or less, more preferably 200 (g) or less, and still more preferably 195 (g) or less.

From the viewpoint of the strength of the shaft, the shaft weight Ws is preferably 30 (g) or more, more preferably 35 (g) or more, and still more preferably 40 (g) or more. From the viewpoints of the swing speed and the flying distance, the shaft weight Ws is preferably 70 (g) or less, more preferably 60 (g) or less, and still more preferably 50 (g) or less.

From the viewpoint of enhancing the hitting force to the ball to increase the flying distance, the head weight Wh is 160 (g) or more, more preferably 177 (g) or more, still more preferably 182 (g) or more, and particularly preferably 187 (g) or more. When the head weight Wh is excessively large, the swing speed is apt to decrease and the flying distance is apt to be reduced. When the head weight Wh is excessively large, it becomes difficult to swing the club and the hit ball directivity is apt to be reduced. From these viewpoints, the head weight Wh is preferably 220 (g) or less, more preferably 197 (g) or less, and still more preferably 192 (g) or less.

In view of the design restriction and the specific gravity of the material, the grip weight Wg is 25 (g) or more, more preferably 30 (g) or more, and still more preferably 35 (g) or more. From the viewpoint of increasing the swing speed to increase the flying distance, the grip weight Wg is preferably 60 (g) or less, more preferably 50 (g) or less, and more preferably 45 (g) or less.

When the weight Ww of the weight member is excessively small, the contact area of the weight member and shaft or the like reduces, and thus the bond strength is apt to reduce. From this viewpoint, the weight Ww of the weight member is 1 (g) or more, more preferably 5 (g) or more, and still more preferably 10 (g) or more. If the club balance is excessively light, the hit ball directivity is apt to reduce. From the viewpoint of preventing the excessively light club balance, the weight Ww of the weight member is preferably 25 (g) or less, and more preferably 20 (g) or less.

Since it becomes difficult to swing the club when the club balance is excessively heavy, the hit ball directivity is apt to reduce. From the viewpoint of preventing the excessively heavy club balance, the weight W2 of the rear end member is 30 (g) or more, more preferably 40 (g) or more, and still more preferably 50 (g) or more. When the club balance is excessively light, the hit ball directivity is apt to reduce. From this viewpoint, the weight W2 of the rear end member is preferably 70 (g) or less, more preferably 60 (g) or less, and still more preferably 55 (g) or less.

When the sum [W1+W2] of W1 and W2 is excessively small, it may become difficult to adjust the counter balance, and thus the flying distance and the hit ball directivity may reduce. When [W1+W2] is excessively small, the durability of members such as the head and the grip is apt to reduce. From these viewpoints, [W1+W2] is preferably 220 (g) or more, more preferably 230 (g) or more, and still more preferably 240 (g) or more. When [W1+W2] is excessively large, the reduction of the hit ball directivity is apt to be caused by the difficulty of swinging, and the swing speed is apt to reduce, and thus the flying distance is apt to reduce. From these viewpoints, [W1+W2] is preferably 270 (g) or less, more preferably 260 (g) or less, and still more preferably 250 (g) or less.

From the viewpoint of enhancing the durability of each of the members and the viewpoint of enhancing the hitting force to the ball to increase the flying distance, the club weight Wt is preferably 250 (g) or more, more preferably 270 (g) or more, and sill more preferably 280 (g) or more. From the viewpoint of enhancing the hit ball directivity by the easiness to swing and the viewpoint of enhancing the swing speed to increase the flying distance, the club weight Wt is preferably 320 (g) or less, more preferably 300 (g) or less, and still more preferably 295 (g) or less.

When [(W1+W2)/Wt] is excessively small, it becomes difficult to adjust the counter balance, and thus the flying distance and the hit ball directivity are apt to reduce. When [(W1+W2)/Wt] is excessively small, the durability of each of the members is apt to reduce. From these viewpoints, [(W1+W2)/Wt] is preferably 0.80 or more, and more preferably 0.82 or more. When [(W1+W2)/Wt] is excessively large, the reduction of the hit ball directivity is apt to be caused by the difficulty of swinging. When [(W1+W2)/Wt] is excessively large, the reduction of the flying distance is apt to be caused by the reduction of the swing speed. From these viewpoints, [(W1+W2)/Wt] is preferably 0.86 or less, and more preferably 0.84 or less.

[(W1+W2)/Wt] is increased to result in the distribution of the weight of the golf club to the tip part and the rear end part. Therefore, in this case, the moment of inertia of the golf club around an axis Ax is increased. This axis Ax passes through the center of gravity of the club and is a perpendicular to the axial line of the shaft. Furthermore, since club length L1 is increased in the present invention, this moment of inertia of the club is further increased. It is believed that the whole action of the club during swing and in impact is likely to be stabilized by increasing this club moment of inertia. The large moment of inertia of the club is believed to contribute to the hit ball directivity and the flying distance. Also from this viewpoint, [(W1+W2)/Wt] is preferably 0.80 or more, and more preferably 0.82 or more. [(W1+W2)/Wt] is still more preferably 0.83 or more.

When [(W1+W2)/Ws] is excessively small, it becomes difficult to adjust the counter balance, and thus the flying distance and the hit ball directivity are apt to reduce. From this viewpoint, [(W1+W2)/Ws] is preferably 4.5 or more, more preferably 4.7 or more, and still more preferably 4.8 or more. When [(W1+W2)/Ws] is excessively large, the weight of the club becomes excessively heavy, and thus it is apt to be hard to swing the club. When the weight Ws of the shaft is excessively small, the strength of the shaft is reduced. From these viewpoints, [(W1+W2)/Ws] is preferably 5.2 or less, more preferably 5.1 or less, and still more preferably 5.0 or less.

The increase in the weight Ww of the weight member causes a larger counter balance effect than that caused by the increase in the grip weight Wg. From this viewpoint, [Ww/Wg] is preferably 0.13 or more, and more preferably 0.26 or more. From the viewpoints of the design restriction and the specific gravity of the material, [Ww/Wg] is preferably 0.50 or less, and more preferably 0.38 or less.

The volume of the head is not limited. From the viewpoint of the moment of inertia of the head, the volume of the head is preferably 380 cc or more, more preferably 390 cc or more, and still more preferably 400 cc or more. From the viewpoint of the golf rule, the volume of the head is preferably 460 cc or less.

The moment of inertia of the head is not limited. From the viewpoint of the hit ball directivity, the lateral moment of inertia of the head is 4000 $g \cdot cm^2$ or more, more preferably 4300 $g \cdot cm^2$ or more, and still more preferably 4500 $g \cdot cm^2$ or more. From the viewpoint of the golf rule, the lateral moment of inertia of the head is preferably 5800 $g \cdot cm^2$ or less. The lateral moment of inertia is measured using MOMENT OF INERTIA MEASURING INSTRUMENT MODEL NO. 005-002 manufactured by INERTIA DYNAMICS INC. The lateral moment of inertia is a moment of inertia around an axis which vertically extends and passes the center of gravity of the head. This axis passes the center of gravity of the head in a standard condition where the head is placed on a horizontal plane at a prescribed lie angle and a prescribed real loft angle and extends in the vertical direction.

The material of the weight member is not limited. From the viewpoint of the counter balance effect, the specific gravity of the weight member is preferably larger than that of the grip. From this viewpoint, the specific gravity of the weight member is preferably 2 or more, and more preferably 7 or more. From the viewpoint of the difficulty in obtaining the material, the specific gravity of the weight member is preferably 20 or less. Preferable examples of the materials include brass, a tungsten nickel alloy, an aluminium alloy, a tungsten alloy, a stainless alloy, stainless steel, and the like.

A fixing method of the weight member is not limited. From the viewpoint of the enhancement of an adhering force, the weight member is preferably bonded to the shaft by the adhesive and/or the double-faced tape. The whole or part of the weight member may be embedded in the grip.

From the viewpoint of enhancing the counter balance effect, a length WL (see FIG. 2) of the weight member in the axial direction is preferably 30 mm or less, more preferably 25 mm or less, and still more preferably 20 mm or less. From the viewpoint of increasing the weight of the weight member, the length WL is preferably 2 mm or more, and more preferably 3 mm or more.

The material of the grip is not limited. A rubber composition and a resin composition are exemplified. As the rubber of the rubber composition, for example, a natural rubber (NR), an ethylene-propylene-diene rubber (EPDM), a styrene-butadiene rubber (SBR), an isoprene rubber (IR), a butadiene rubber (BR), a chloroprene rubber (CR), and an acrylonitrile butadiene rubber (NBR) or the like may be used. The natural rubber, or a rubber obtained by blending (mixing) the natural rubber with the ethylene-propylene-diene rubber or styrene-butadiene rubber or the like having a good affinity for the natural rubber are particularly preferable. Examples of the resins contained in the resin composition include a thermoplastic resin. This thermoplastic resin may be used for injection molding. As this thermoplastic resin, a thermoplastic elastomer is preferable, and a thermoplastic elastomer containing a soft segment and a hard segment is more preferable. From the viewpoint of attaining both grip performance and abrasion resistance, a urethane-based thermoplastic elastomer is more preferable.

The material for the head is not limited. As the material for the head, titanium, a titanium alloy, CFRP (Carbon Fiber Reinforced Plastic), stainless steel, a maraging steel, a magnesium alloy, an aluminium alloy, iron and the like are exemplified. The head may be obtained by combining a plurality of materials. The head may be obtained by joining a head body produced by casting and a face part produced by forging or pressing together.

The structure of the head is not limited. The head may be integrally formed as a whole or may be obtained by joining a plurality of members. The producing method of the head is not limited. As the producing method of the head, casting such as lost wax precision casting, forging, and the like are exemplified.

The material of the shaft is not limited. As the material for the shaft, CFRP (carbon fiber reinforced plastic) and metal are exemplified. A so-called carbon shaft and a steel shaft may be suitably used. The structure of the shaft is not limited.

EXAMPLES

Hereinafter, the effects of the present invention will be clarified by examples. However, the present invention should not be interpreted in a limited way based on the description of examples.

[Producing Example of Head]

A face plate was welded to a cast head body, the head body made of a titanium alloy. The face plate was obtained by press working a rolled plate material made of a titanium alloy. The welded head was polished to obtain a head A1 of 177 g. The volume of the head A1 was 455 cc.

Example 1

A lead sheet was attached on the head A1, and the weight of the head A1 was adjusted to a head weight Wh described in Table 1. A ferrule was driven into a shaft, and the head was then bonded on the tip part of the shaft. The weight of the ferrule was 1.5 g. An adhesive was used for bonding. The weight of the adhesive was 1.5 g. The shaft, which was a laminated body made of a carbon fiber-reinforced resin layer, had a hollow structure. The weight of the shaft was set to 50 g. As shown in FIG. 2, a weight member was bonded on the rear end part of the shaft by an adhesive (the weight of the adhesive is less than 0.5 g), and a grip was then attached thereto. The inner diameter of the shaft 6 and the outer diameter of a small-diameter part 22 were adjusted so that the thickness of an adhesive layer between the weight member and the inner circumference surface of the shaft was set to about 0.05 mm. The grip was made of a vulcanized rubber, and the weight Wg of the grip was 38 g. The weight Ww of the weight member was 5 g. The grip and the shaft were bonded using a double-faced tape. Thus, a golf club of example 1 was obtained.

Examples 2 to 4 and Comparative Examples 1, 2

Golf clubs of examples were obtained in the same manner as in example 1 except that the head weight Wh and the weight Ww of the weight member were changed as shown in Table 1. The head weight Wh was adjusted by adjusting the weight of a lead sheet. In comparative example 2, the head A1 was used as it was without attaching the lead sheet for weight adjustment. The weight Ww of the weight member was adjusted by the material of the weight member, the length of a large-diameter part 24 in the axial direction, the length of the small-diameter part 22 in the axial direction, and the pore diameter of a through-hole 26. As the material of the weight member of 5 g, a stainless alloy was used. As the material of the weight member of 10 g, brass was used. As the material of the weight members of 15 g, 20 g and 25 g, a tungsten alloy was used.

The evaluation results of examples and comparative examples are shown in the following Table 1.

[Evaluation of Flying Distance]

Ten testers whose head speeds are from 35 to 42 m/s evaluated the flying distance. Each of ten testers hit balls ten times per each of the golf clubs, and the flying distance of each of the hit balls was measured. As the ball, trade name "XXIO XD" manufactured by SRI Sports Limited was used. The "XXIO XD" is a three-piece solid golf ball. The flying distance was measured based on a position where the ball finally stopped. Hundred data in total were averaged per each of the golf clubs. This average value was indexed based on a value of comparative example 1 being 100. This flying distance index is shown in the following Table 1. The larger this flying distance index is, the larger the flying distance.

[Evaluation of Hit Ball Directivity]

The hit ball directivity was evaluated simultaneously with the measurement of the flying distance. The hit ball directivity was measured based on the position where the ball finally stopped as in the flying distance measurement. The hit ball directivity is a deviation distance to the target direction. Irrespective of either right or left the ball was deviated to, the deviation distance was defined as a positive value. Hundred data in total were averaged per each of the golf clubs, and an inverse number of this average value was calculated. This inverse number was indexed based on the value of comparative example 1 being 100 to obtain directional indexes. The directional index is shown in the following Table 1. The larger this directional index is, the better the hit ball directivity is.

TABLE 1

Specifications and Evaluation Results of Examples and Comparative Examples

| | Unit | Comparative Example 1 | Example 1 | Example 2 | Example 3 | Example 4 | Comparative Example 2 |
|---|---|---|---|---|---|---|---|
| Club Length L1 | mm | 1162 | 1162 | 1162 | 1162 | 1162 | 1162 |
| Head Weight Wh | g | 202 | 197 | 192 | 187 | 182 | 177 |
| Ferrule Weight | g | 2 | 2 | 2 | 2 | 2 | 2 |
| Weight of Adhesive | g | 2 | 2 | 2 | 2 | 2 | 2 |
| Weight W1 of Tip Member | g | 205 | 200 | 195 | 190 | 185 | 180 |
| Shaft Weight Ws | g | 50 | 50 | 50 | 50 | 50 | 50 |
| Grip Weight Wg | g | 38 | 38 | 38 | 38 | 38 | 38 |
| Weight Ww of Weight Member | g | 0 | 5 | 10 | 15 | 20 | 25 |
| Weight of Double-faced Tape | g | 2 | 2 | 2 | 2 | 2 | 2 |
| Weight W2 of Rear End Member | g | 40 | 45 | 50 | 55 | 60 | 65 |
| W1 + W2 | g | 245 | 245 | 245 | 245 | 245 | 245 |
| Wt | g | 295 | 295 | 295 | 295 | 295 | 295 |
| (W1 + W2)/Wt | — | 1 | 1 | 1 | 1 | 1 | 1 |
| (W1 + W2)/Ws | — | 5 | 5 | 5 | 5 | 5 | 5 |
| W2/W1 | — | 0 | 0 | 0 | 0 | 0 | 0 |
| Ww/Wg | — | 0 | 0 | 0 | 0 | 1 | 1 |
| Flying Distance (index) | — | 100 | 101 | 103 | 103 | 101 | 99 |
| Hit Ball Directivity (index) | — | 100 | 103 | 108 | 119 | 118 | 107 |

As shown in Table 1, examples are highly evaluated as compared with comparative examples. From the evaluation results, the advantages of the present invention are apparent.

The present invention can be applied to all the golf clubs.

The above description is only illustrative and various changes can be made without departing from the scope of the present invention.

What is claimed is:

1. A golf club comprising:

a shaft;

a tip member provided at a tip part of the shaft, wherein the tip member includes a golf club head;

a rear end member attached to a rear end part of the shaft, wherein the rear end member includes a grip;

a weight adjusting material provided in or on the head; and a ferrule, an adhesive and a double-faced tape; wherein the head and the shaft are bonded by the adhesive, the shaft and the grip are bonded by the double-faced tape, a weight Ws of the shaft is no less than 30 g and no more than 50 g;

the rear end member includes a weight member, the weight member is provided on a rear side relative to a tip position of the grip, and the weight member has a specific gravity larger than that of the grip;

the golf club has a club length of 1143 mm or more; and a value of [W2/W1] is no less than 0.26 and no more than 0.32 when a weight of the tip member is W1 (g) and a weight of the rear end member is W2 (g);

the weight W1 includes a weight of the weight adjusting material, a weight of the adhesive and a weight of the ferrule;

the weight W2 includes a weight of the double-faced tape;

a weight Ww of the weight member is no less than 10 (g) and no more than 25 (g); and the weight W2 of the rear end member is no less than 30 (g) and no more than 55 (g); and a value is no less than 0.26 when a weight of the grip is Wg.

2. The golf club according to claim 1, wherein the weight W1 of the tip member is no less than 160 (g) and no more than 195 (g).

3. The golf club according to claim 1, wherein the weight Wg of the grip is no less than 25 (g) and no more than 45 (g).

* * * * *